US012460436B2

(12) United States Patent
Guttieri

(10) Patent No.: US 12,460,436 B2
(45) Date of Patent: Nov. 4, 2025

(54) MOUNTING DEVICES FOR A POOL COVER AND METHOD OF INSTALLING A SWIMMING POOL COVER

(71) Applicant: Peter Guttieri, Commack, NY (US)

(72) Inventor: Peter Guttieri, Commack, NY (US)

( * ) Notice: Subject to any disclaimer, the term of this patent is extended or adjusted under 35 U.S.C. 154(b) by 0 days.

(21) Appl. No.: 18/772,982

(22) Filed: Jul. 15, 2024

(65) Prior Publication Data

US 2025/0137272 A1 May 1, 2025

Related U.S. Application Data

(60) Provisional application No. 63/634,743, filed on Apr. 16, 2024, provisional application No. 63/626,775, filed on Jan. 30, 2024, provisional application No. 63/546,078, filed on Oct. 27, 2023.

(51) Int. Cl.
*E04H 4/08* (2006.01)

(52) U.S. Cl.
CPC ..... *E04H 4/08* (2013.01)

(58) Field of Classification Search
None
See application file for complete search history.

(56) References Cited

U.S. PATENT DOCUMENTS

| | | | | |
|---|---|---|---|---|
| 3,148,384 | A * | 9/1964 | Bartolucci | E04H 4/10 4/503 |
| 3,520,004 | A * | 7/1970 | Patnaude | E04H 4/10 24/265 R |
| 5,388,283 | A * | 2/1995 | Garnett | E04H 4/10 4/503 |
| 5,388,284 | A * | 2/1995 | Garnett | E04H 4/103 4/503 |
| 11,866,954 | B1 * | 1/2024 | Morales | E04H 4/144 |
| 2005/0258315 | A1 * | 11/2005 | Bigham | F16L 3/137 248/74.3 |
| 2019/0161987 | A1 * | 5/2019 | Lewis | E04H 4/10 |
| 2023/0106559 | A1 * | 4/2023 | Guttieri | E04H 4/06 4/496 |

* cited by examiner

*Primary Examiner* — Steven M Marsh
(74) *Attorney, Agent, or Firm* — COZEN O'CONNOR

(57) ABSTRACT

An anchor device and a method of installing a pool cover with and without a surrounding deck. The anchor device having a planar portion, a bracket insert, and a downwardly projecting leg. The downwardly projecting leg is inserted into a slot between deck boards from where a user will tilt and press the anchor down such that the planar portion is partially in contact with the deck boards. If a pool is surrounded by a soft ground material, the method utilizes pool anchors having a spiral portion and a hex drive body at the first end of the spiral portion. The anchor is driven into the ground via the hex drive body to a desired depth, an anchor screw is inserted into the hex drive body, and a pool cover mount is attached to the anchor screw.

10 Claims, 23 Drawing Sheets

Marksmen Manufacturing Corporation
MMC - Slip In Bracket #2 With Post

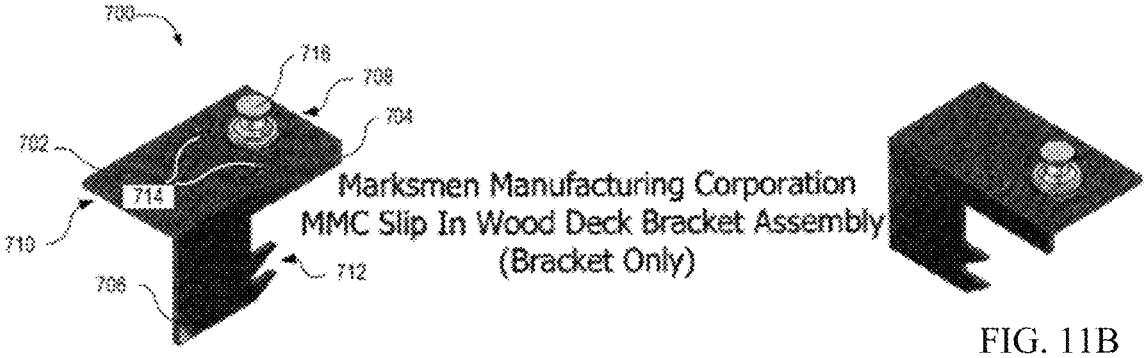
FIG. 11A
FIG. 11B
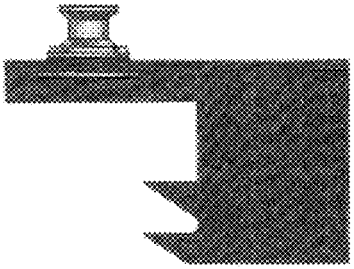
FIG. 11C
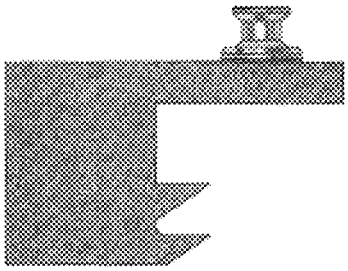
FIG. 11D

FIG, 12C

Marksmen Manufacturing's
Wood Deck Bracket Setting Tool

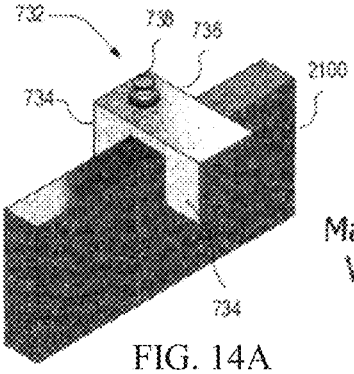
FIG. 14A
Marksmen Manufacturing Corporation
Wood Deck Slip In Strattle Bracket
With 2 X 6 Wood Joist
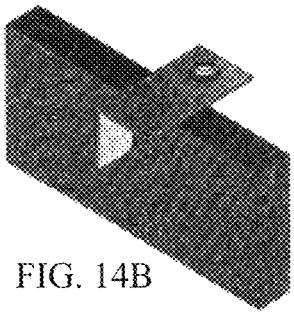
FIG. 14B
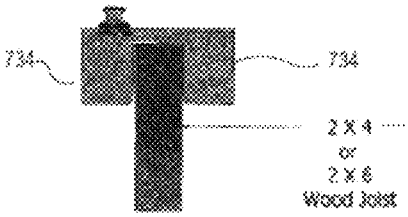
FIG. 14C
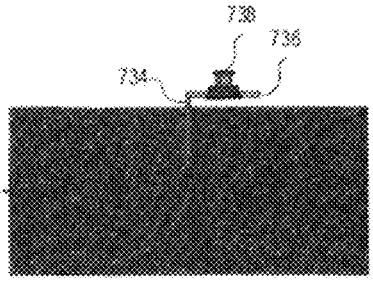
FIG, 14D

MOUNTING DEVICES FOR A POOL COVER AND METHOD OF INSTALLING A SWIMMING POOL COVER

CROSS REFERENCE TO RELATED APPLICATIONS

This application claims priority to U.S. Provisional Patent Application No. 63/546,078, filed Oct. 27, 2023, U.S. Provisional Patent Application No. 63/626,775, filed Jan. 30, 2024, and U.S. Provisional Patent Application No. 63/634,743, filed Apr. 16, 2024, each of which is incorporated herein by reference.

FIELD OF THE INVENTION

The present disclosure relates to a deck anchor and a method for installing a pool cover for an inground pool with and without a finished deck surrounding the pool.

DESCRIPTION OF THE RELATED ART

Pool covers serve multiple purposes in the field of pool maintenance and safety. Pool covers keep dirt and debris away from pools while also helping owners cut down on water losses. They may also act as barriers to prevent accidental falls into the pool, particularly for young children and pets during an offseason when the pool is closed.

When an inground pool is constructed, the surrounding area is usually provided time to settle before a permanent structure is installed, such as a cement or wood deck surrounding the pool. Once the permanent deck is installed, the pool cover can be attached to the permanent structure to provide a secure installation thereon. Pool covers are secured over a pool through a plurality of drawbar assemblies mounted between straps of a pool cover. Mounting anchors are affixed in surrounding material of the pool, such as pavers, cement or wood decking. A closed end of a drawbar is looped over an upstanding stud of the fixed mounting anchor, and the other end is attached to an adjustable strap connected to the pool cover. The adjustable strap is tightened to removably fix the drawbar and, hence, the strap and pool cover, to the fixed anchor.

The cover is positioned to cover the pool, aligning it accurately with the installed anchors and straps. The straps are connected to the anchors, pulled tight to achieve a secure and snug fit. Some covers come equipped with a built-in tensioning system, simplifying the adjustment process for optimal tightness. Once installed, the cover is tested to ensure the cover is securely in place. The tension of the straps is adjusted, as needed, to achieve a desired level of tautness. If desired, any excess material from the cover is trimmed according to the manufacturer's recommendations, creating a neat and tailored appearance in the landscape.

A problem with known permanent assemblies is that the mounting anchors are often permanently fixed to decking material surrounding the pool and are so-positioned when such material is installed, such as in the case of concrete, wood, or brick pavers. When the cover is in place, such an assembly is not a concern because the pool is closed for the season. However, when the pool is opened, i.e. when the cover is removed, the mounting anchors will remain in place, thereby creating an unsightly appearance around the pool. Moreover, because these mounting anchors are secured to the surrounding area by being drilled or screwed in, there may be some discomfort to bare feet which come in contact with the permanent anchors. If any associated screws come loose or are not fully implanted, they can also cause a safety risk. These mounting anchors can also be inconvenient because they must be installed in the exact right position, as they are not easily removable. In situations where the anchors are removed, the mounting holes needed to attach the anchors to the mounting surface are relatively large—typically around 1 inch in diameter, leaving an unsightly appearance around a periphery of the pool.

Further challenges are presented whenever one wants to provide a secure installation of a pool cover in an area where there is no permanent surrounding structure. To install such a pool cover, mounts are required. Temporary corrosion-resistant anchors are selected and installed within the landscape surrounding the pool. For landscapes without a deck, options like ground anchors or anchor cups are used.

Ground anchors are made of durable materials like stainless steel, and are designed to be embedded directly into the ground around the pool. Installation involves creating holes in the ground and securing the anchors in place, providing attachment points for the cover. Anchor cups are another option suitable for landscapes. Anchor cups are placed into the ground around the pool. Anchor cups offer a recessed pocket for the anchors when they are not in use, maintaining a seamless and visually pleasing appearance in landscape installations.

Anchors are aligned precisely according to the cover manufacturer's guidelines. Properly spaced and aligned anchors are crucial for effective cover installation and secure fastening. Durable, weather-resistant straps, which are part of the cover or attached to the cover, are used to connect the cover to the installed anchors. The straps are evenly distributed across the cover to ensure uniform tension during installation.

However current ground anchors or anchor cups do not provide sufficient anchoring security for pool covers. What is needed is an easily installed pool anchor for the surrounding area of pools that would be able to provide sufficient anchoring security while not compromising the appearance of a pool's surrounding area.

SUMMARY OF THE INVENTION

The present invention relates to an anchor device and a method of using the anchor device to install a pool cover on the surrounding area of a pool-whether it be a deck area, or on soft ground.

In some aspects, the techniques described herein relate to a method of covering a pool surrounded by a deck with a pool cover using a pool anchor having a planar bracket portion with a bracket insert and a second section configured to be inserted in a slot between deck boards. If the second section includes a longitudinally extending tooth, the method comprises: inserting a tab end of the second section into a slot between deck boards so that the at least one longitudinally extending tooth is adjacent to a joist and the second section is perpendicular to the joist; driving the at least one longitudinally extending tooth into the joist; and attaching a pool cover mount to a portion of the bracket insert. If the second section does not have a longitudinally extending tooth, the method comprises: inserting a tab end of the second portion into slot between deck boards; pressing the pool anchor so that the planar bracket portion is at least partially in contact with the deck boards; and attaching a pool cover mount to a portion of the bracket insert.

In some aspects, the method includes placing a pool anchor adjacent to a deck joist.

In some aspects, the method includes a pool strap is looped around the bracket insert.

In some aspects, the method includes a tensioning element is looped around the bracket insert wherein a first end of the tensioning element will be positioned facing the pool anchor, and a second end of the tensioning element opposite the first end will be positioned facing the pool cover.

In some aspects, the planar bracket portion is secured to the deck by using at least one screw or nail.

In some aspects, the method includes: inserting a setting tool between adjacent boards on the deck; inserting the tab end of the second section into a slot between deck boards so that at least one longitudinally extending tooth is adjacent to a joist and the second section is perpendicular to the joist; positioning the setting tool such that the setting tool presses up against the pool anchor; and driving the at least one tooth into the joist.

In some aspects, the techniques described herein relate to an anchor including: a planar portion; a bracket insert that extends from a first side of the planar portion, the bracket insert having a narrowed portion spaced apart from a distal end of the bracket insert; and a downwardly projecting leg that extends from a second side of the planar portion opposite the first side.

In some aspects, the downwardly projecting leg comprises: a base portion that extends perpendicularly from the second surface of the planar portion; a curved portion that extends from the base portion; and a tab end that extends from the curved portion. At least one longitudinally extending tooth can extend horizontally from the base portion, or extend from the curved portion while positioned perpendicularly from the second surface of the planar portion.

In some aspects, the second side of the planar portion is contoured further comprising a mount section, an end section, and a center section between the mount section and the end section.

In some aspects, a thickness of the mount section and the end section is greater than a thickness of the center section.

In some aspects, a thickness of the mount section is greater than a thickness of the end section.

In some aspects, the mount section has a chamfer at its respective longitudinal end.

In some aspects, the first side of the planar portion defines a hole that goes through to the second side of the planar portion.

In some aspects, the bracket insert further comprises of: a base portion that rests upon a surface of the center section of the second side of the planar portion; a knurled portion adjacent to the base portion; a first end of the narrowed portion adjacent to a proximal end of the bracket insert; a second end of the narrowed portion adjacent to the distal end of the bracket insert; a first beveled section that leads into the first end of the narrowed portion; and a second beveled section that leads into the second end of the narrowed portion.

In some aspects, the knurled portion of the bracket insert is configured to be press fit in a hole defined in the planar portion.

In some aspects, the base portion of the bracket insert is configured to be larger than a hole defined in the planar portion.

In some aspects, the techniques described herein relate to an anchor comprising a second downwardly projecting leg that extends from the second side of the planar portion wherein the second downwardly projecting leg mirrors the downwardly projecting leg.

In some aspects, the techniques described herein relate to an anchor, wherein the downwardly projecting leg is perpendicular to the second surface of the planar portion.

In some aspects, the techniques described herein relate to a pool that is surrounded by soft ground, e.g., is not surrounded by a permanent deck, and, more specifically, to a method of covering such a pool with a pool cover using a pool anchor having a spiral portion and a hex drive body at a first end of the spiral portion including: driving the pool anchor into the ground surrounding the pool via the hex drive body to a desired depth; inserting an anchor screw into the hex drive body; and attaching a pool cover mount to a portion of the anchor screw.

Other objects, features, and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF THE DRAWINGS

The following detailed description references the drawings, in which:

FIGS. 11A-11D show a pool anchor in side perspective views and left and right side views;

FIGS. 12A-12D show a pool anchor in left side, right side, front, and top views;

FIGS. 14A-14D show a removable bracket and anchor assembly in side perspective views and side views;

DETAILED DESCRIPTION OF THE EXEMPLARY EMBODIMENTS

Figure 1:
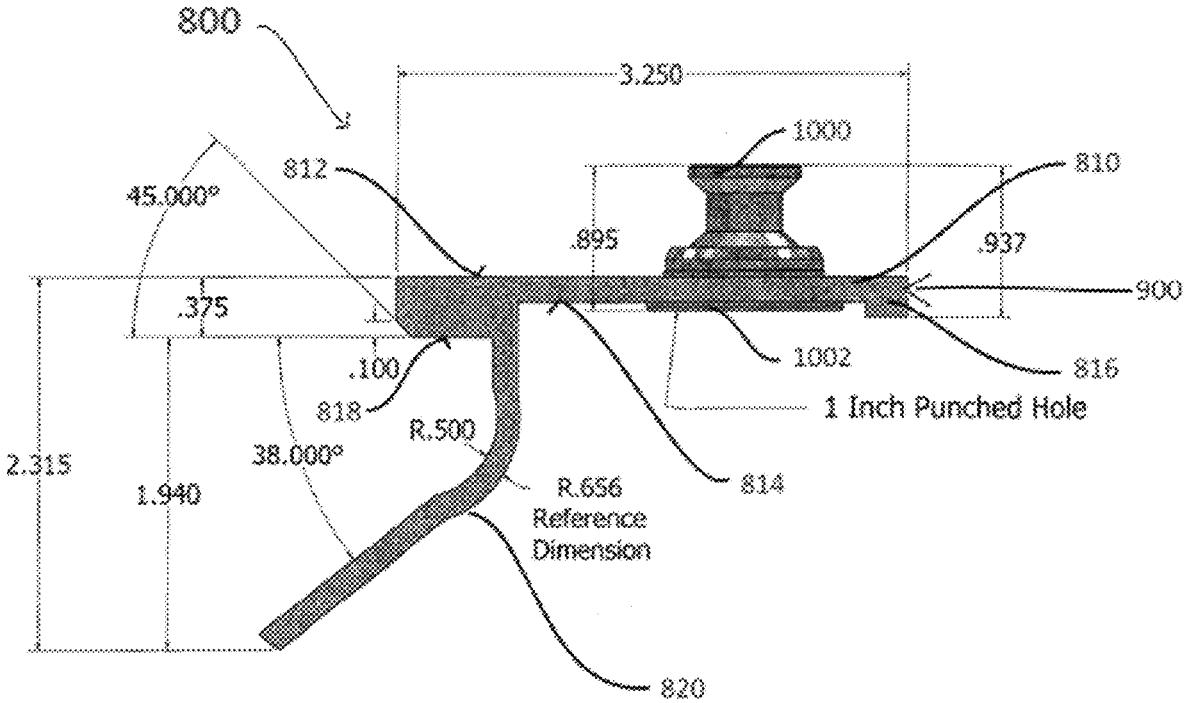
FIG. 1 is a side view of a pool anchor.

In accordance with an aspect of the present invention, a pool cover anchor is provided with a removable functionality that allows the anchor to be removed from a mounting surface so that such anchors are no longer permanent during in season use of the swimming pool, i.e. when a cover is removed from the pool. The removable bracket and anchor assembly includes a unitary construction member having a top plate that is generally rectangular with a front edge, a back edge, and two side edges. A flange extends downwardly from the top plate. The flange is along one side edge from a front edge to a back edge. A portion of the flange from the back edge includes a downwardly projecting leg. One or more teeth extend from the leg towards the front edge. Alternatively, the downwardly projecting leg can be proximate to the back edge, extending downwardly perpendicular to the side edges. A component for securing a pool cover is attached to a top plate, which can also include mounting holes.

When the mounting surface is a deck of wood or a composite material where individual boards are mounted on joists, there is typically some space between adjacent boards. The downwardly projecting leg is inserted into such a space, whereby a user can subsequently mount the anchor and attach a pool cover to a portion of the anchor.

A description of the present disclosure will now be given with reference to the figures. All technical terms used herein are to have the same meaning as commonly understood by one of ordinary skill in the art. It is expected that the present disclosure may be embodied in other specific forms without departing from its spirit or essential characteristics. The scope of the disclosure is, therefore, indicated by the appended claims rather than by the foregoing description. All changes come within the meaning and range of equivalency of the claims and are to be embraced within their scope. Furthermore, any figures, methods, and illustrations presented herein are intended for demonstrative purposes and are in no way intended to be limitations on the scope of the invention.

Pool cover installation begins by measuring the pool to be covered and selecting an appropriate cover that provides desired features. Additionally, the anchor style must be selected. For an unfinished landscape, pool anchor 100 is selected. For a deck mounted cover, pool anchor 800 is selected.

Once the cover is selected, locations for pool anchors 100,800 are determined. The locations for the pool anchors 100,800 are based on at least the pool cover, the shape of the pool, and the landscape. Once the locations are determined, and optionally marked, the pool anchors 100,800 are driven respectively into the ground/deck.

When the pool anchor 800 is used, it must be placed on a deck made of boards. To place the pool anchor, the tab end 826 is inserted into a slot 2010 between two boards 2000. When the curved portion 824 meets the board 2000, the pool anchor 800 is tilted and subsequently pressed down in a manner that the anchor's planar bracket portion 900 is at least partially in contact with the deck boards. The positioning of the anchors 800 on the deck will depend on the orientation of the pool with respect to the boards 2000 and, particularly, with respect to the longitudinal axis of the slots 2010 (See FIGS. 10A-10D). If the pull direction is perpendicular or otherwise slightly angled with respect to the direction of the slots, the anchors can be placed along the deck in any manner that would be suitable to provide securement of the pool cover. If the pull direction is oriented parallel to or otherwise substantially along the direction of the slots, then the anchor 800 should be place behind, or adjacent to a joist 2100 in manner that the anchor will not slide along the slots.

When the pool anchor 100 is used, the pool anchor 100 is inserted into the ground surrounding a pool 606. A protective sleeve on the sharp point 114 of the spiral portion 102 is first removed, if one is present. Preferably, the pool anchor 100 is driven with a power driver fitted with a 1.25 or other appropriately sized socket, corresponding with the hex drive body 104. Alternatively, a hand tool such as a socket wrench, a ratchet wrench, a box wrench, a T-wrench, or the like can be used to drive the pool anchor 100. The sharp point 114 of the spiral portion 102 is placed in contact with the ground at the desired installation location. While holding the pool anchor 100, the socket of the power driver is placed over the distal end of the pool anchor 100, specifically the hex drive body 104. The power driver is activated to drive the pool anchor 100 into the ground. If the pool anchor 100 includes a stop 120, driving stops when the stop engages the ground surface. If no stop 120 is present, the driving stops when the pool anchor 100 is driven to a desired depth, leaving a portion of the hex drive body 104 protruding slightly from the ground. Typically, the pool anchor 100 is driven into the ground until about 1 inch or less of the hex drive body 104 remains above the ground surface. It should be noted that because the anchor screw 106 is threadingly installed in the hex drive body 104 prior to driving the pool anchor 100 into the ground, the hex drive body 104 can be below the ground surface.

Once the pool anchor 100 is driven into the ground, the anchor screw 106 can be unscrewed exposing the smaller diameter portion 504, which is used for retaining either a pool strap 608 or a tensioning element 602.

After the cover is positioned to cover the pool and aligned with pool anchors 100 or pool anchors 800, a pool strap 608 or a tensioning element 602 is looped around the anchor screw 106 and seated in the smaller diameter portion 504 or looped around the bracket insert 1000 and seated in the narrowed portion 1008. If a tensioning element 602 is used, one end of the tensioning element faces the pool anchor 100, 800 and the opposite end of the pool anchor 100, 800 faces the pool cover. The straps 608 are connected to the anchor screws 106 or bracket insert 1000 and pulled tight to achieve a secure and snug fit.

Once either pool anchor 100,800 is installed, the cover is tested to ensure the cover is securely in place. The tension of the straps is adjusted, as needed, to achieve a desired level of tautness.

For cover removal, a drill can be used to remove screws, if used, and the disclosed mounting brackets may be easily removed from the deck for later reuse. Because the diameter of the screw is small, only small holes remain once the screw is removed, thereby improving the aesthetic appearance of the property surrounding the pool.

FIG. 1 is a side view of a pool anchor 800 configured for mounting a pool cover or other accessory to a deck. The pool anchor 800 can be used to secure items to a deck during high wind conditions or for security. The pool anchor 800 has a bracket portion 900 and a bracket insert 1000. The bracket portion 900 has a top plate 810 configured to mount in a manner that is substantially parallel to a deck surface. A downwardly projecting leg 820 of the bracket portion 900 extends from the top plate 810 and is configured to be inserted in a space between two deck boards.

A top surface 812 of the top plate 810 is generally planar. A second surface of the top plate 810 that is opposite the first surface, which faces the deck, is contoured. In one aspect of the invention, the second surface has a center section 814 that is bounded longitudinally by an end section 816 and a mount section 818. The end section 816 is typically configured as a lip. The mount section 818 typically has a greater height than the lip of the end section 816. The center section is thinner than the end section 816 to accommodate a base portion 1002 of the bracket insert 1000.

Figure 2:
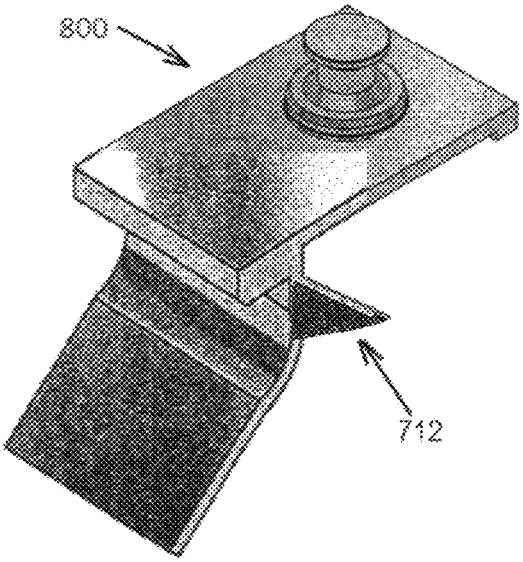
FIG. 2 is a perspective view of a pool anchor that features an extending tooth.
Figure 3:
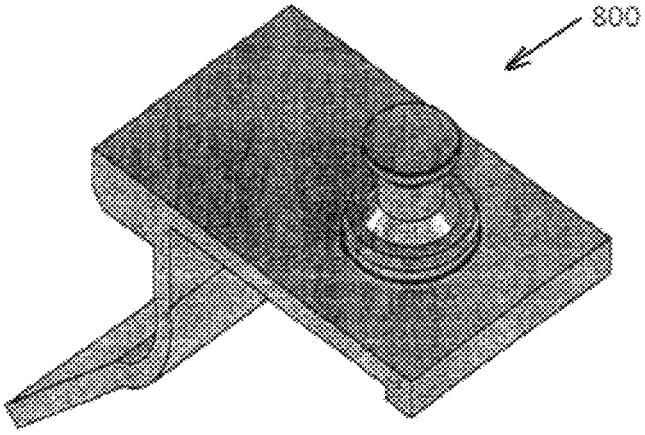
FIG. 3 is a perspective view of the pool anchor.

FIG. 2 is a perspective view of the pool anchor 800. FIG. 2 shows an aspect of the invention where the anchor comprises one projecting tooth 712 extending horizontally from a base portion 822 (base portion shown in FIG. 4). FIG. 3 is a perspective view of the pool anchor from an opposite side. According to one aspect of the invention, the bracket insert 1000 is closer to the end section 816 than the mount section 818.

Figure 4:
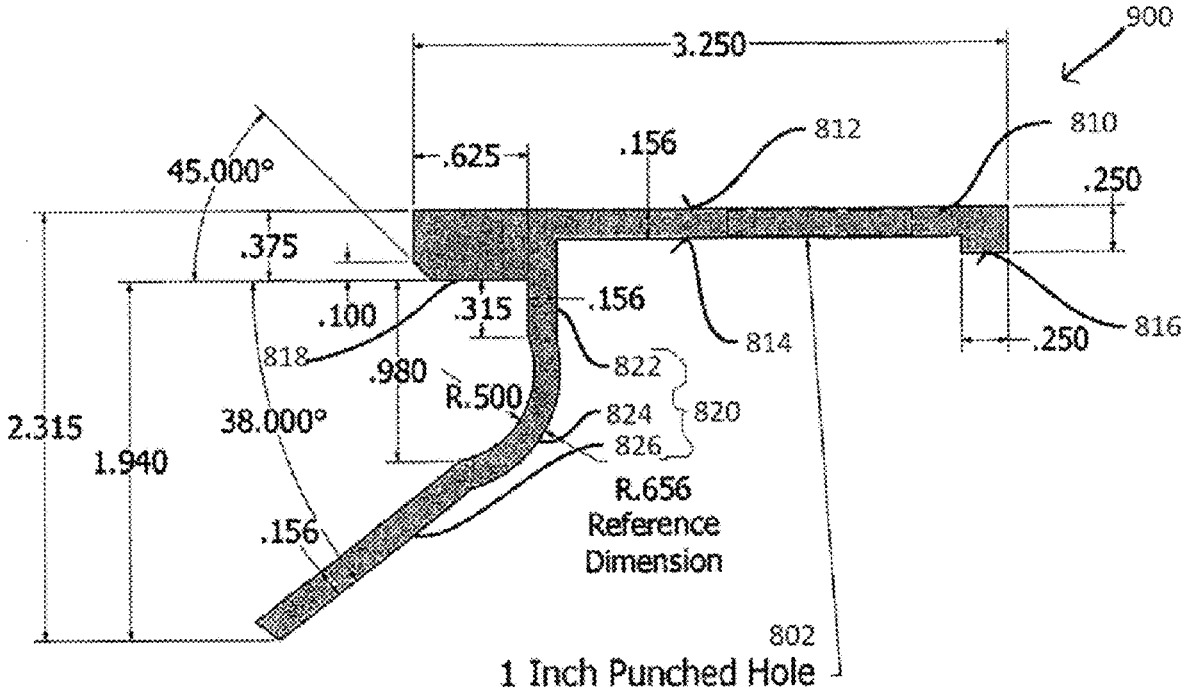
FIG. 4 is a side view of a bracket portion of the pool anchor.
Figure 5:
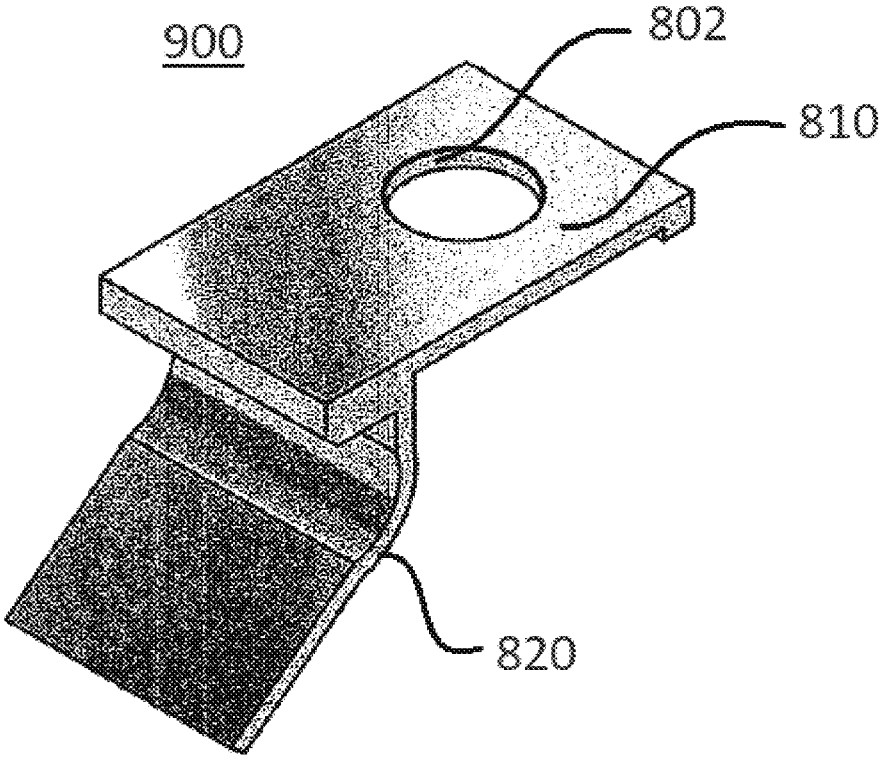
FIG. 5 is a perspective view of a bracket portion of the pool anchor.

FIG. 4 is a side view of a bracket portion 900 of the pool anchor 800 prior to insertion of the bracket insert 1000. FIG. 5 is a perspective view of a bracket portion 900 prior to installation of the bracket insert 1000.

The bracket portion 900 has a hole 802 formed therein that receives the bracket insert 1000. Typically, the hole 802 is a punched hole. According to one aspect of the invention, the hole 802 is one inch in diameter. FIG. 4 shows an aspect of the invention where the end section 816 is configured as a 0.25 inch by 0.25 inch segment and the mount section is 0.375 inches tall and 0.625 inches deep. This height difference provides a tolerance for the pool anchor 800 to tilt slightly when in use.

As shown in FIG. 4, the bracket portion 900 has a downwardly projecting leg 820 configured to fit between two pieces of decking to retain the pool anchor 800 in an installed state. The downwardly projecting leg 820 has a base portion 822 that is substantially perpendicular to the top surface 812, a curved portion 824, and a tab end 826 that is angled with respect to the base portion. The base portion 822 extends from the top plate 810 between the mount section 818 and the center section 814. In one aspect of the invention, an angle between the base portion 822 and the tab end 826 is 52°, which is formed by a 0.5 inch radius curve of the curved portion 824. The downwardly projecting leg 820 is dimensioned to fit between deck slots. According to one aspect of the invention, the downwardly projecting leg 820 is 0.156 inches thick and as wide as the bracket portion 900, which is typically 2 inches. In a preferred embodiment, the bracket portion 900 is a portion of an aluminum extrusion.

According to one aspect of the invention, the downwardly projecting leg can contain at least one longitudinally extending tooth 712. The at least one tooth can extend horizontally from the base portion 822, or extend from the curved portion 824 while positioned perpendicularly from the top plate 810.

According to one aspect of the invention, the mount section 818 has a 45° chamfer at its outer distal end. The chamfer is configured to assist during installation of the pool anchor 800 and prevent damage to the deck material.

According to one aspect of the invention, a distal end of the tab end 826 extends longitudinally beyond an end of the mount section 818.

Figure 6:
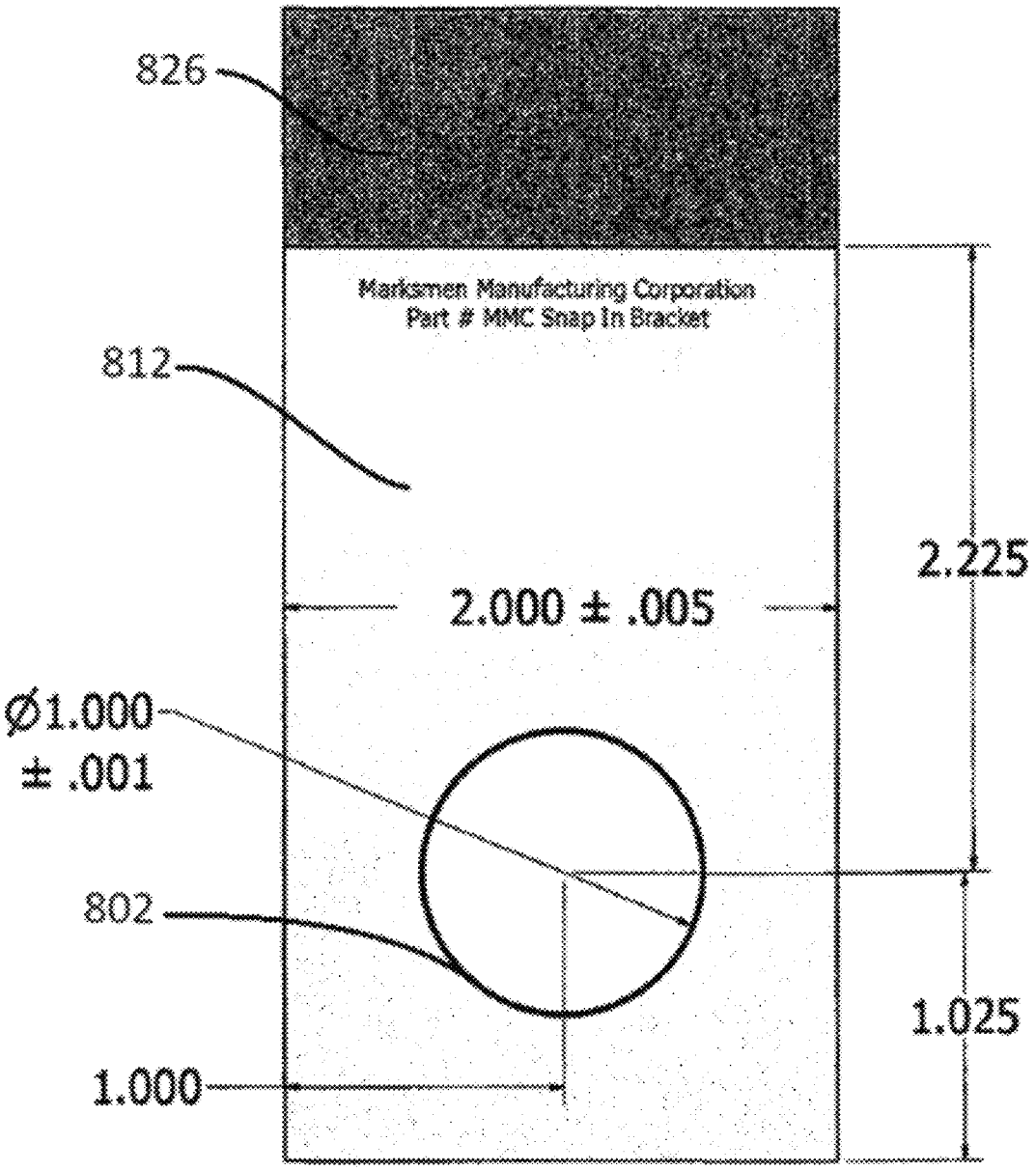
FIG. 6 is a perspective view of a bracket portion of the pool anchor.

FIG. 6 is a top view of the bracket portion 900 of the pool anchor prior to installation of the bracket insert 1000. According to one aspect of the invention, the top surface 812 is about 2 inches by 3.25 inches. The tab end 826 extends longitudinally beyond an end of the top surface 812. A marking can be stamped on the top surface 812. The bracket portion 900 has a hole 802 formed from the top surface 812 that receives the bracket insert 1000. The hole 802 is arranged in the center section 814, about 1.025 inches from an edge of the end section 816. FIG. 6 shows an aspect of the invention where the hole 802 goes entirely through to the other side of the bracket portion 900.

Figure 7:
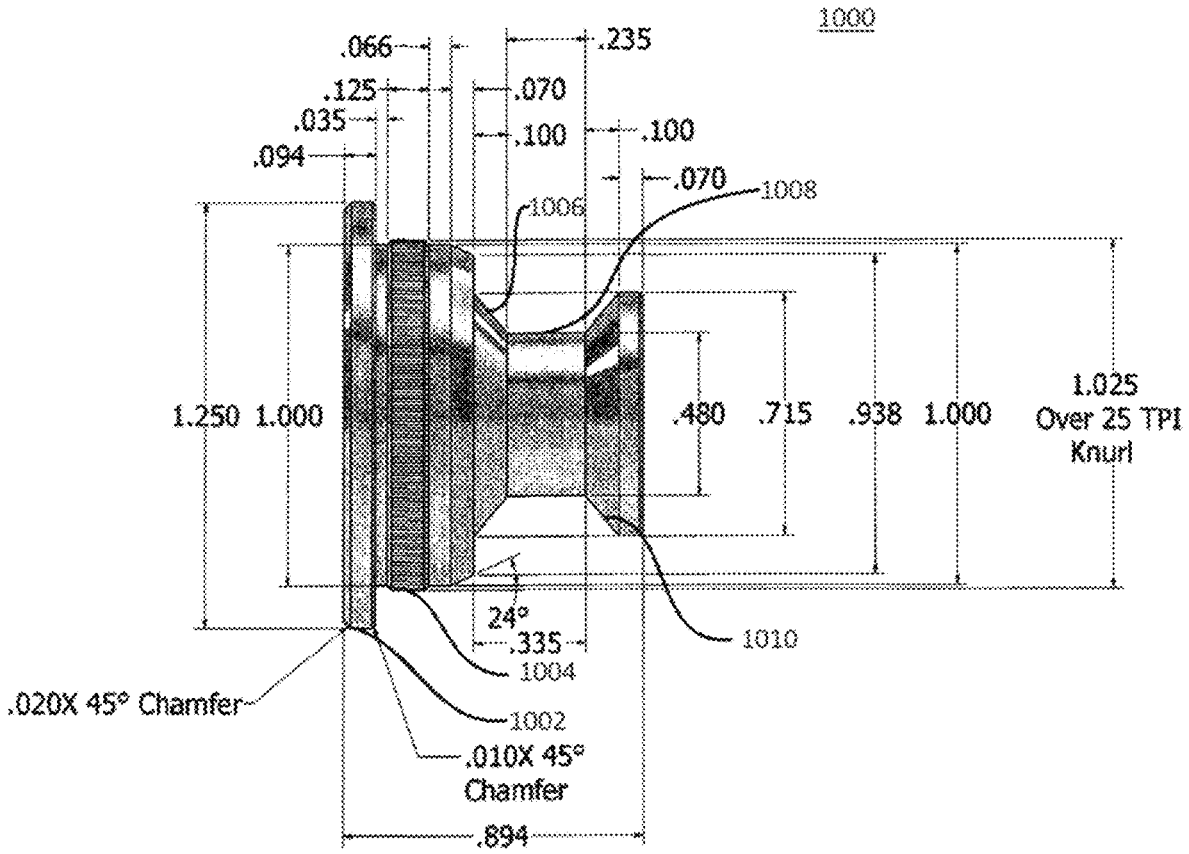
FIG. 7 is a side detail of a bracket insert of the pool anchor.

FIG. 7 is a side detail of the bracket insert 1000 of the pool anchor. The base portion 1002 is configured to be larger than hole 802 and rest upon a surface of the center section 814. A knurled portion 1004 is adjacent to the base portion and is configured to be press fit in the hole 802. Preferably a chamfered lead-in is provided to ease insertion of the bracket insert 1000 into the hole 802. It should be noted that in place of the knurling, a thread can be provided and the hole 802 can be tapped with a complementary thread. Alternatively, the bracket insert 1000 is welded to the bracket portion 900. Alternatively, the hole is a blind hole and the bracket insert ends at the knurled portion 1004, which is press fit into the blind hole. The bracket insert 1000 has a first beveled section 1006 and a second beveled section 1010 that both lead into a narrowed portion 1008. The narrowed portion 1008 is configured for a tensioning element 602 to be affixed thereto. The narrowed portion 1008 extends between the distal end of the bracket insert to the proximal end of the bracket insert 1000. The first beveled section 1006 leads into the side of the narrowed portion 1008 adjacent to the proximal side of the bracket insert, whereas the second beveled section 1010 leads out of the end of the narrowed portion adjacent to the distal end of the bracket insert 1000. The beveled sections 1006, 1010 keep the tensioning element centered within the narrowed portion 1008.

Figure 8:
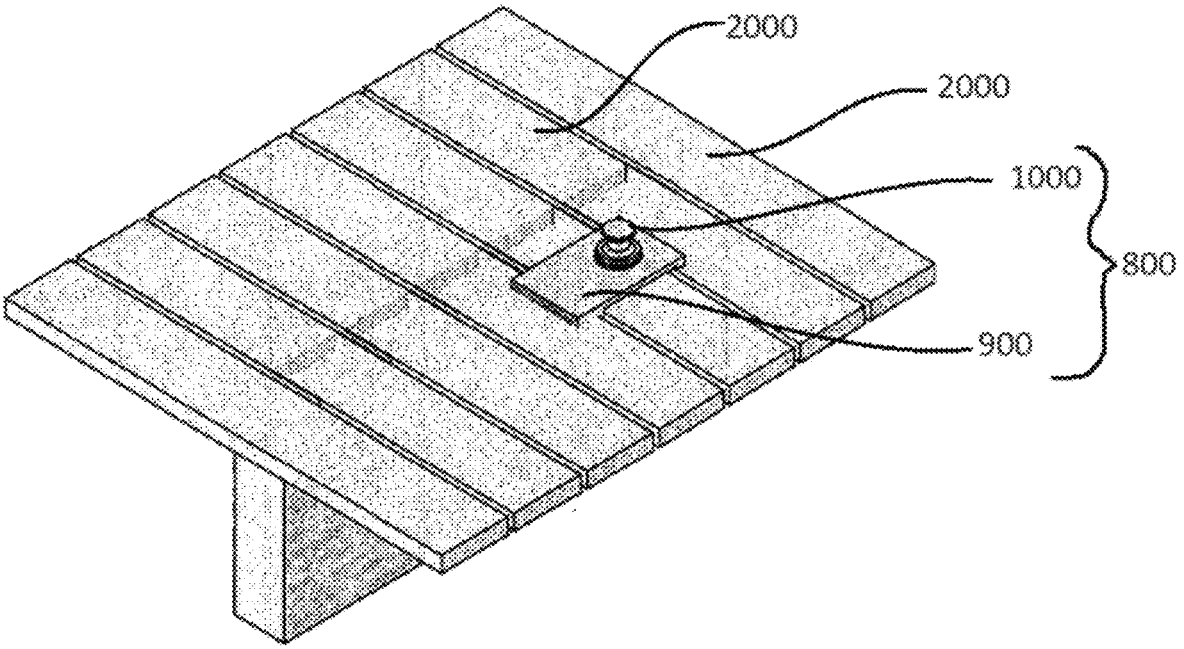
FIG. 8 is a perspective view of the pool anchor installed on a deck.

FIG. 8 is a perspective view of the pool anchor 800 installed on a deck made of boards 2000. The bracket portion 900 is substantially flush with a surface of the deck.

Figure 9:
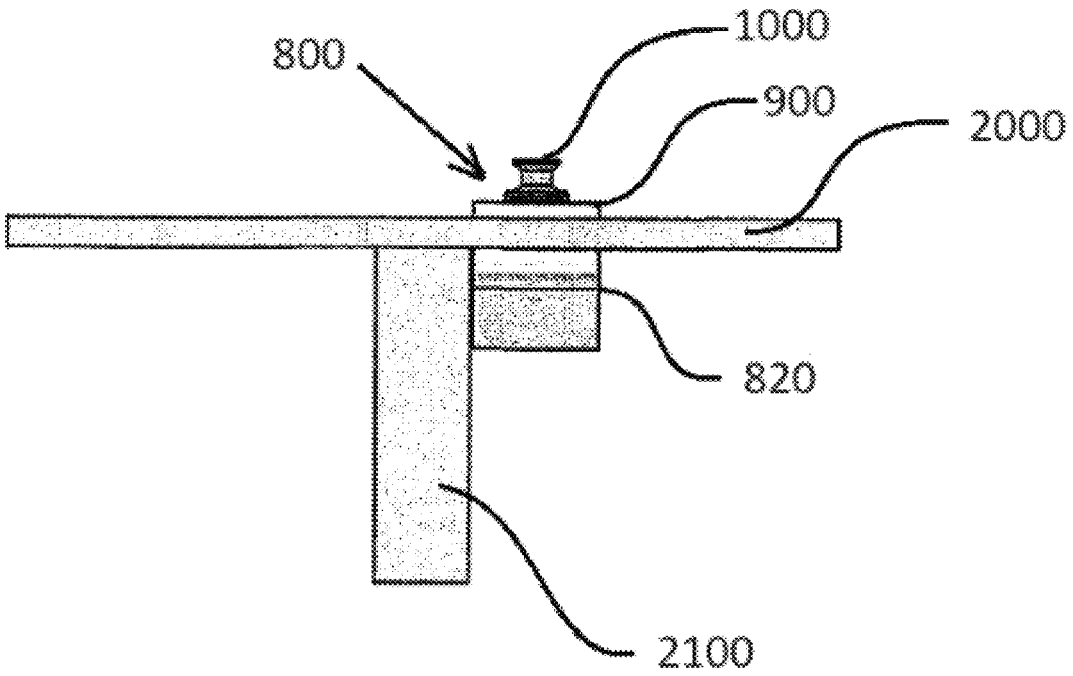
FIG. 9 is a front view of the pool anchor installed on the deck.

FIG. 9 is a front view of the pool anchor 800 installed on a deck made of boards 2000. As shown, the pool anchor is adjacent to a beam or joist 2100. However, it is not essential for the pool anchor to be installed adjacent to a beam. As shown, the downwardly projecting leg 820 extends below the deck surface, whereas the bracket insert 1000 protrudes above the deck surface.

FIGS. 10A-10D show views of the pool anchor 800 installed on the deck. As shown, the downwardly projecting leg 820 extends through a slot 2010 between two boards 2000 of a deck (See FIG. 10C). The base portion 822 extends partially beyond a board 2000, while the curved portion and the tab end are spaced apart from the boards 2000. The positioning of the anchors 800 on the deck will depend on the orientation of the pool with respect to the boards 2000 and, particularly, with respect to the longitudinal axis of the slots 2010. In particular, if the pull direction is perpendicular or otherwise slightly angled with respect to the direction of the slots, the anchors can be placed along the deck in any suitable manner to provide securement of the pool cover (See FIGS. 10A and 10C). However, if a pull force is oriented in a direction substantially along the direction of the slots, e.g., parallel to the slots, then it is desired to place the anchors behind, or adjacent to, a joist 2100 (See FIGS. 10B and 10D) to prevent the anchors from sliding along the slot 2010.

According to one aspect of the invention, a removable bracket and anchor assembly 700 is shown in FIGS. 11A-11D and includes a unitary construction member having a top plate 702 that is generally rectangular with a front edge 708, a back edge 710 and two side edges. A flange 704 extends downwardly from top plate 702 along one side edge from front edge 708 to back edge 710. It should be noted that the flange 704 may only extend along a portion of the respective side edge. A portion of the flange 704 starting at any point along the back edge 710 includes a downwardly projecting leg 706. One or more teeth 712 extend from a leg 706 towards the front edge 708. A bracket insert or anchor 716 is provided for securing a pool cover and is attached to the top plate 702, which also include mounting holes 714. FIGS. 11A-11D shows assembly 700 in side perspective views (FIGS. 11A, 1B) and left and right side views (FIGS. 11C, 1D).

Installation of assembly 700 on a deck will be discussed with reference to FIGS. 12A-D. A deck is formed by a plurality of boards 2000 secured to a beam or joist 2100 by nails, screws, brackets, or any other suitable mechanism. A joist 2100 may also be referred to as a rafter. The leg 706 of the bracket 700 is inserted in a slot between two adjacent boards 2000 so that the teeth 712 are adjacent to the joist 2100 and the leg 706 is perpendicular to the joist 2100. During installation, the teeth 712 are driven into the joist 2100 using a setting tool 722, described in connection with FIG. 13. This will position mounting holes 714 above the joist 2100 so that screws or nails may be used to secure the bracket 700 to the deck.

The setting tool 722 is shown in FIGS. 13A-13E. Like the bracket 700, a setting tool 722 includes a top plate 724 and a downwardly projecting leg 726. The setting tool 722 also includes a driving flange 728 extending upward from a top plate 724. In use, the setting tool 722 is inserted between adjacent boards 2000 so that a front edge 730 of setting tool 722 is pressed against a back edge 710 of a bracket 700 that is positioned with its at least one longitudinally extending tooth 712 adjacent to a joist 720. To drive teeth 712 into a joist 720, a hammer or other striking tool may be used against the driving flange 728 to urge the setting tool 722 against the bracket 700.

FIGS. 14A-14D shows another aspect of a removable bracket and anchor assembly. Straddle bracket 732 includes a top plate 736 and two downwardly projecting legs 734. The top plate 736 includes a bracket insert or anchor 738. Legs 734 are inserted between two boards (not shown) on either side of a joist 2100. Mounting holes (not shown) may be provided in the top plate 736 as described above.

FIGS. 15A-15E is a removable bracket and anchor assembly. A slip-in bracket 742 includes a top plate 744 and a downwardly projecting leg 746. The leg 746 is parallel to a back end 748 instead of to a side edge as seen in the bracket 700. Leg 746 is also spaced away from the back end 748 to provide space for a mounting hole 750. Similarly to brackets 700 and 732, top plate 744 also includes a bracket insert 1000. The back end may also comprise of a hole 750 provided for an optional hold-down screw. FIG. 15 also shows an aspect of the invention where the anchor comprises one projecting tooth 712 extending horizontally from the downwardly projecting leg 746.

According to one aspect of the invention, some or all of the mounting bracket can contain a coating, such as rubber, plastic, a chemical treatment, or the like to prevent discoloration of the deck surface when the anchors are removed. It is contemplated that the brackets can be formed of steel, aluminum, brass, carbon fiber, plastic, or any other durable material.

Figure 16:
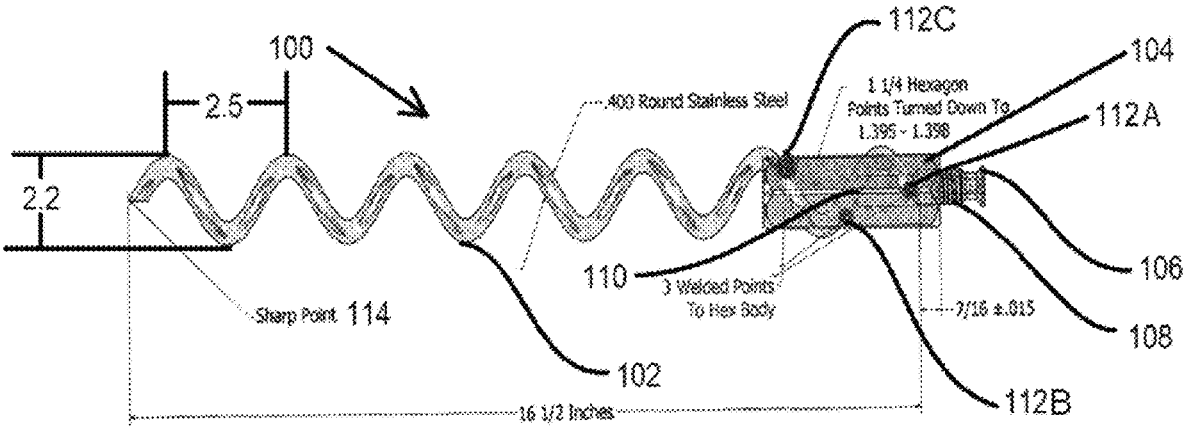
FIG. 16 is a side view of a pool anchor.
Figure 17:
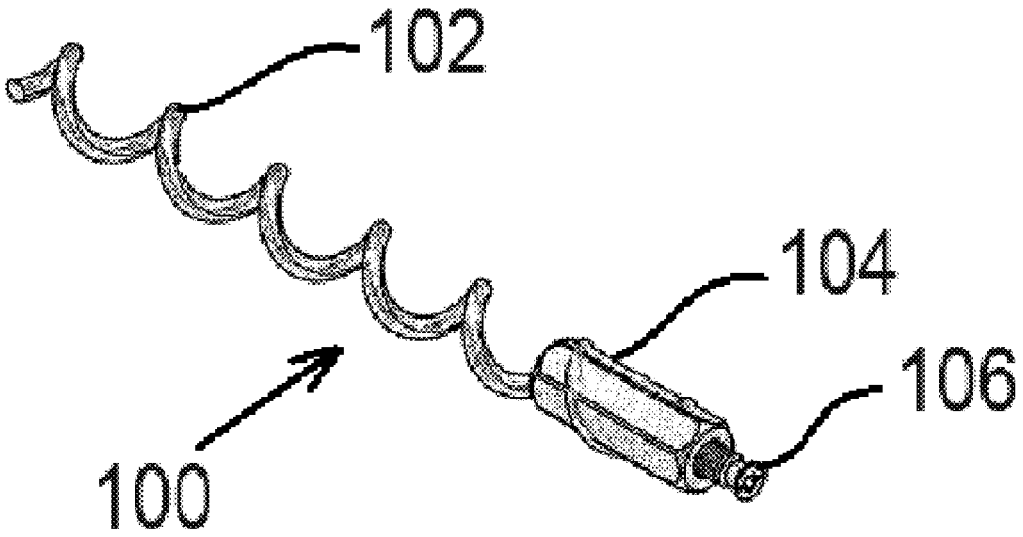
FIG. 17 is a perspective view of the pool anchor.

FIG. 16 is a side view of a pool anchor 100. FIG. 17 is a perspective view of a pool anchor. The pool anchor 100 comprises a spiral portion 102, which is configured to be driven into the ground, and a hex drive body 104. The spiral portion is typically 0.393 diameter 18-8 Stainless Steel, although other materials may be used such as, aluminum, coated steel, galvanized steel, powder coated steel, carbon fiber, and plastic. According to one aspect of the invention, the spiral portion is about 16.5 inches having a 2.2 inch outside coil diameter and wound at a 2.5 inch pitch. The spiral portion 102 is typically 0.400 diameter stock. The spiral portion 102 preferably has a sharp point 114 at its distal end to ease entry into the ground.

The hex drive body 104 is typically a 1.25 inch hexagon, made from 303 Stainless Steel, with at least a portion turned down to about 1.395-1.398 inches to form a friction fit with the spiral portion 102. Other materials for the hex drive body 104 include aluminum, coated steel, brass, carbon fiber, plastic. The hex drive body 104 has an internal thread configured to accept an anchor screw 106. A threaded portion 108 of the anchor screw 106 extends into the hex drive body about 7/16 of an inch.

The spiral portion 102 is welded to the hex drive body 104. Preferably, the spiral portion 102 is welded to the hex drive body 104 in three locations 112A, 112B, 112C. Preferably, the hex drive body 104 has a radial hole 408 configured to accept an end of the spiral portion 102 that is bent to extend radially inward into the hex drive body 104. The hole 110 can extend the entire length of the hex drive body 104.

While shown with an anchor screw 106 installed and not fully seated, for storage purposes the anchor screw is preferably fully seated. Alternatively, for storage, or prior to installation of the anchor screw 106, a plug can be provided. The plug can be a plastic plug that is threadingly connected or frictionally connected.

Figure 18:
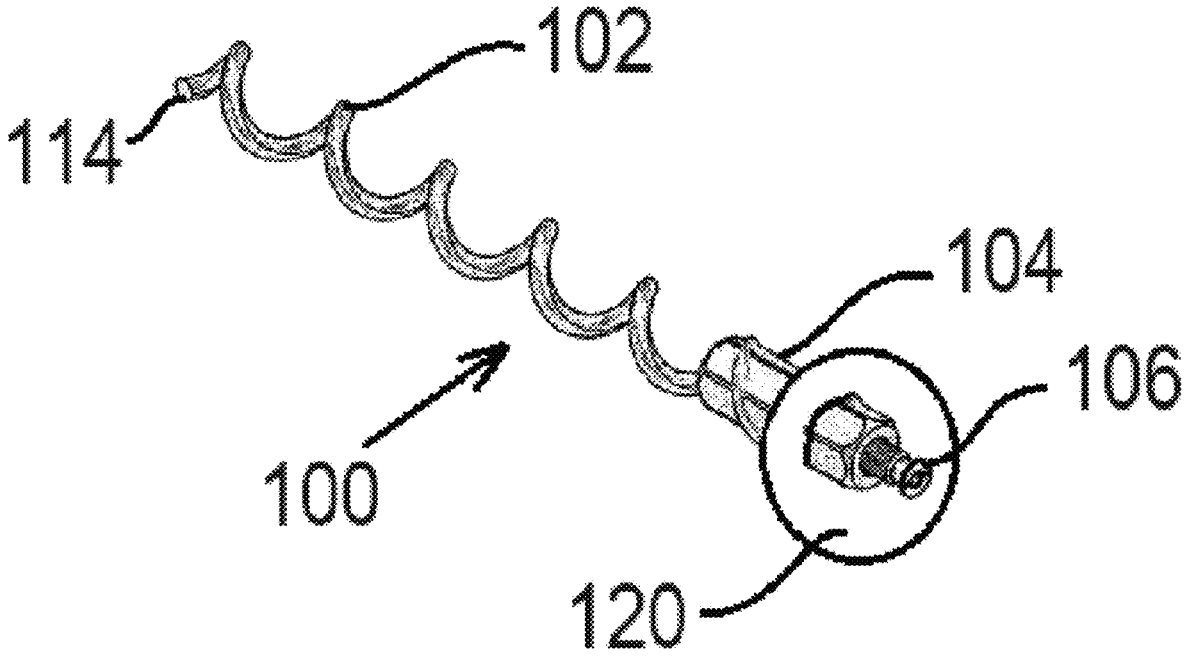
FIG. 18 is a perspective view of the pool anchor.

FIG. 18 is a perspective view of a pool anchor 100 having a stop 120. The stop 120 is a washer-like element formed with the hex drive body 104 or affixed to the hex drive body 104. The stop 120 is affixed to the hex drive body 104 by welding, gluing, threading, or the like. The stop has about a 2 inch diameter and is configured to rest on a surface of the ground and prevent the hex drive body 104 from being entirely embedded in the ground. The stop 120 is offset from an end of the hex drive body 104 by about 1 inch to keep the end of the hex drive body 104 from becoming embedded in the ground.

Figure 19:
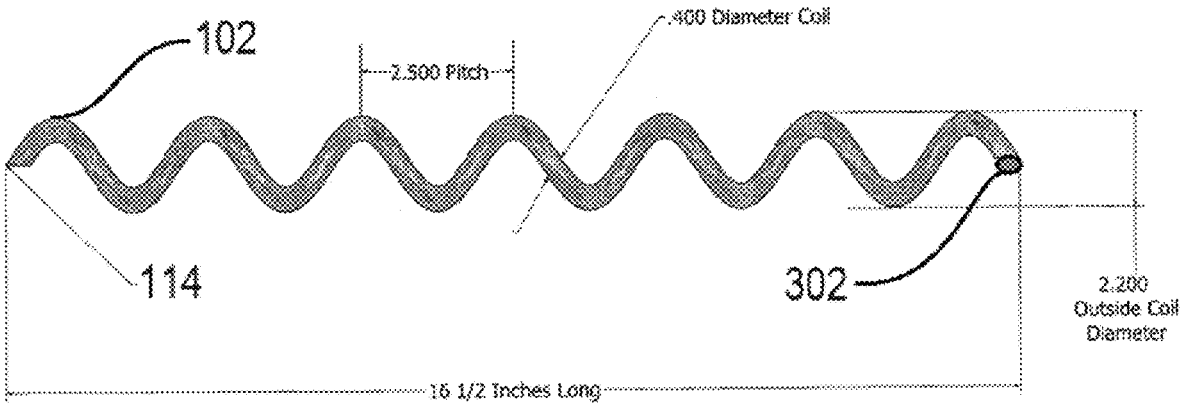
FIG. 19 is a detail of the screw portion of the pool anchor.

FIG. 19 is a detail of the spiral portion 102 of the pool anchor 100. An end 302 of the spiral portion 102 that is bent to extend radially inward (into the page). The sharp point 114 assists in penetrating hard soil, ice, and the like. The sharp point 114 can be covered with a protective sleeve after manufacturing for shipping and sales. The spiral shape aids in avoiding obstacles such as rocks.

Figures 20A, 20B, 20C:
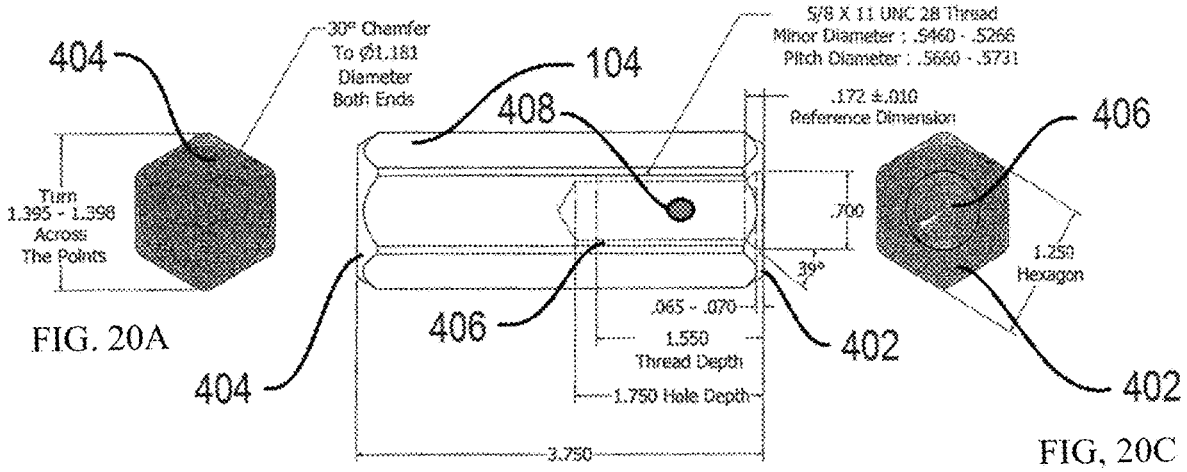
FIG. 20A-20C is a detail of a hex body of the pool anchor in side view and end views.

FIGS. 20A-20C show a detail of the hex drive body 104 of the pool anchor 100. The hex drive has an internal thread 406 configured to receive the threaded portion 108 of the anchor screw 106. A hole 408 is drilled into an end 402 of the hex drive body 104 that receives the end 302 of the spiral portion 102. A second end 404 of the hex drive body 104 is preferably chamfered. The chamfer eases threading the spiral portion 102 onto the hex drive body 104.

Figures 21A, 21B:
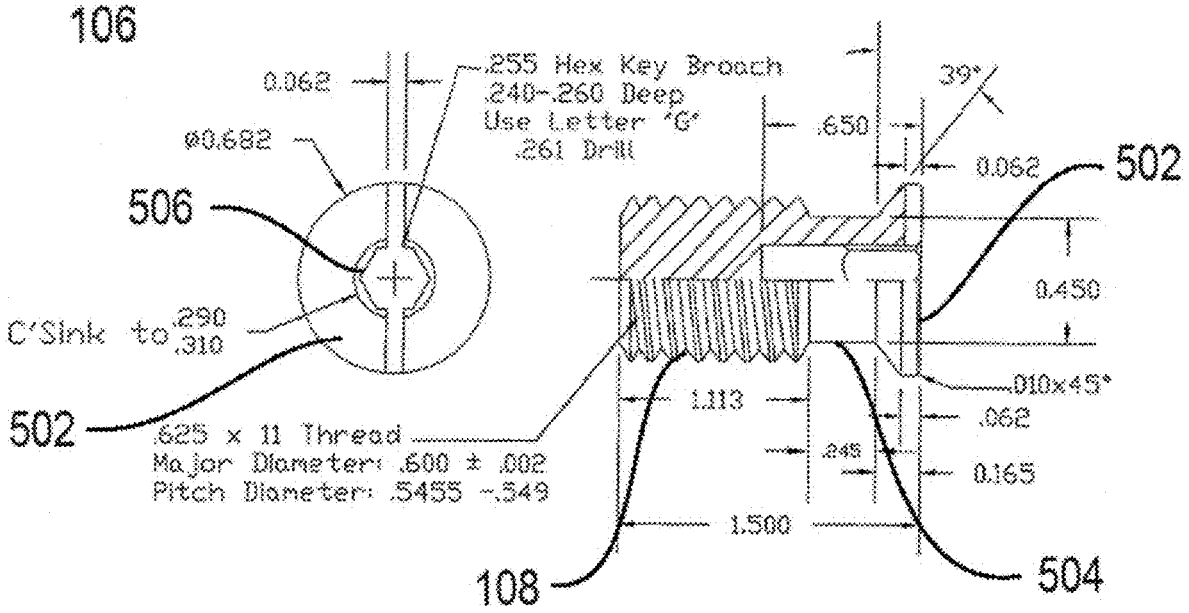
FIG. 21A-21B is a detail of an anchor screw in side and end views.

FIGS. 21A, 21B show a detail of the anchor screw 106. Preferably, the anchor screw 106 is 11/16 round 303 stainless steel, although other materials may be used such as, aluminum, coated steel, brass, carbon fiber, plastic, etc. The anchor screw 106 has a threaded portion 108 that screws into the internal thread 406 of the hex drive body 104. The anchor screw 106 has a smaller diameter portion 504 to engage a pool cover strap. An end 502 of the anchor screw 106 is configured to drive the pool anchor 100 into the ground. To facilitate driving, the end 502 has a hex key broach 506. While described as an anchor screw, it should be noted that other fittings can be screwed into the hex drive body 104, depending on the application.

Figure 22:
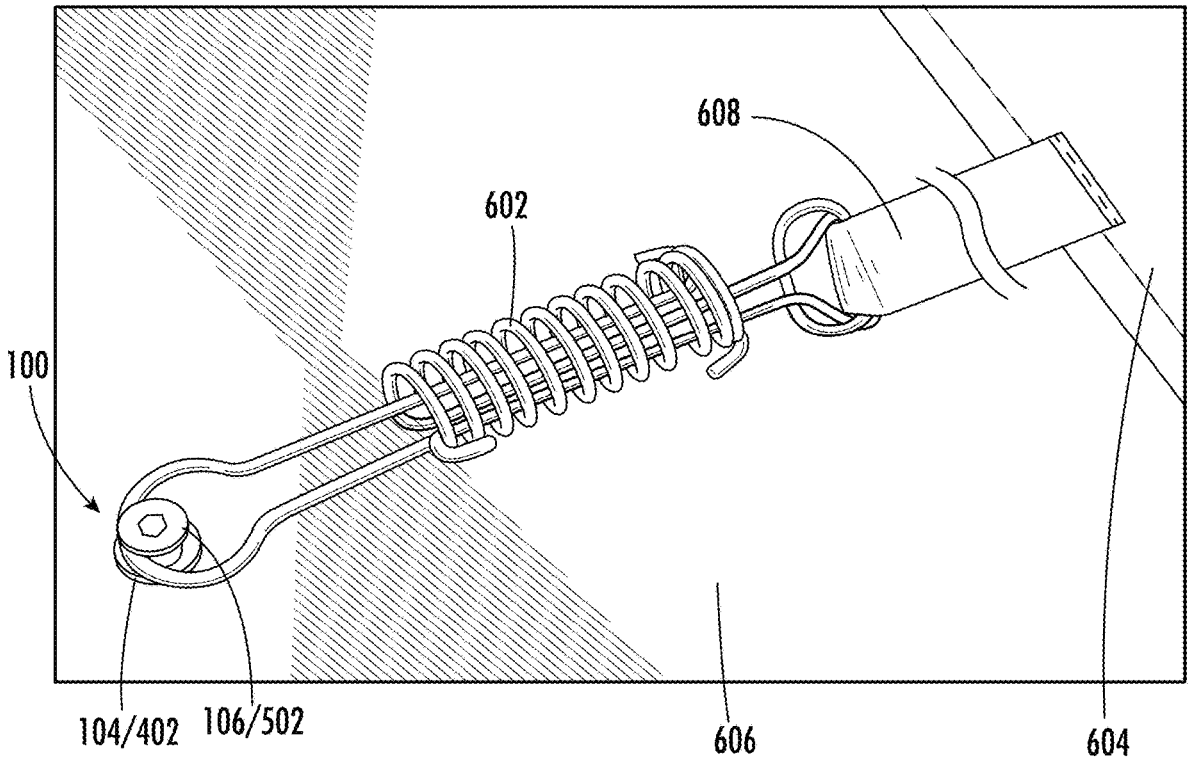
FIG. 22 is a portion of an installed pool covering using the anchoring screw.

FIG. 22 is portion of an installed pool cover 604 using the pool anchor 100. Only a portion of the pool cover 604 is shown. The pool anchor 100 is installed in soil or landscaping 606 surrounding a pool. A tensioning element 602 is arranged in the smaller diameter portion of the anchor screw 106. Alternatively, the strap 608 can be arranged in the smaller diameter portion of the anchor screw 106. The end 402 of the hex drive body 104 is shown flush with the soil surface. The tensioning element 602 is attached to a strap 608 of the pool cover 604. As would be understood, multiple pool anchors 100 are positioned about the periphery of the pool to hold the pool cover 604, while only one is shown.

Figure 23:
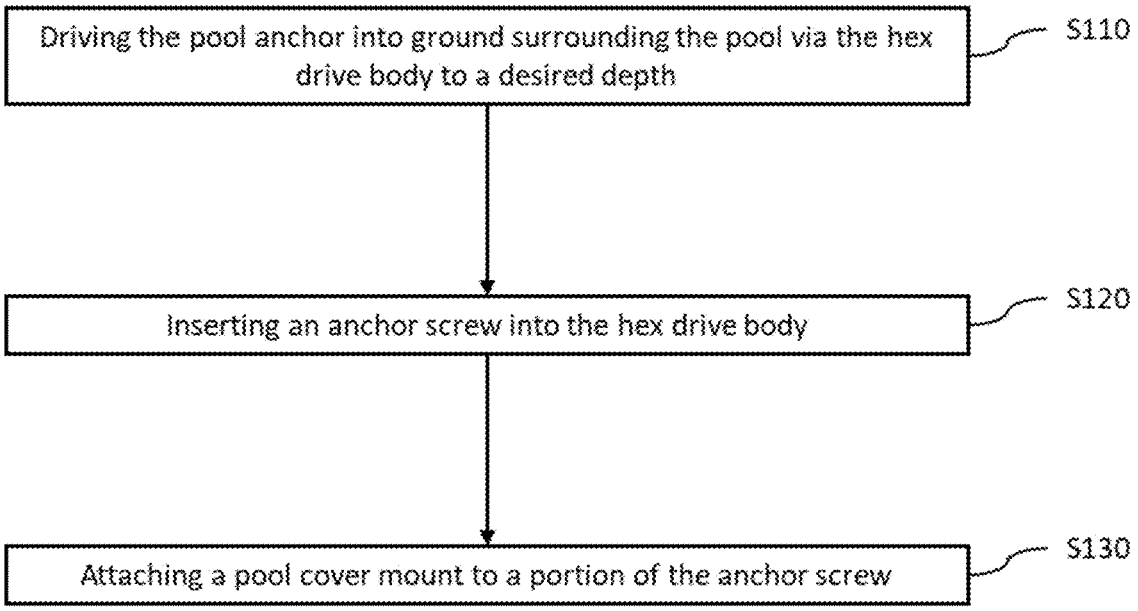
FIG. 23 is a flowchart for installing a pool cover using the anchoring screw.

FIG. 23 is a flowchart for installing a pool cover using the anchoring screw, pool anchor 100. The pool anchor 100 is configured for use before a pool deck is installed with permanent anchors embedded therein. The pool anchor 100 is configured to be driven into a lawn or landscaping so that a pool cover can be attached thereto. The pool anchor 100 can be removed when not in use. Alternatively, when the pool anchor 800 is used, the pool anchor 800 is attached to the deck.

At step S110, the pool anchor 100 is driven into the ground surrounding the pool via the hex drive body to a desired depth. Alternatively, the pool anchor 800 is attached to the deck surrounding the pool as discussed above.

At step S120 an anchor screw 106 is inserted into the hex drive body 104.

At step S130 a pool cover mount, which can be a pool cover strap or a tensioning element, is attached to a portion of the anchor screw 106. Alternatively, a pool cover mount, which can be a pool cover strap or a tensioning element, is attached to the portion of the bracket insert 1000.

Figure 24A:
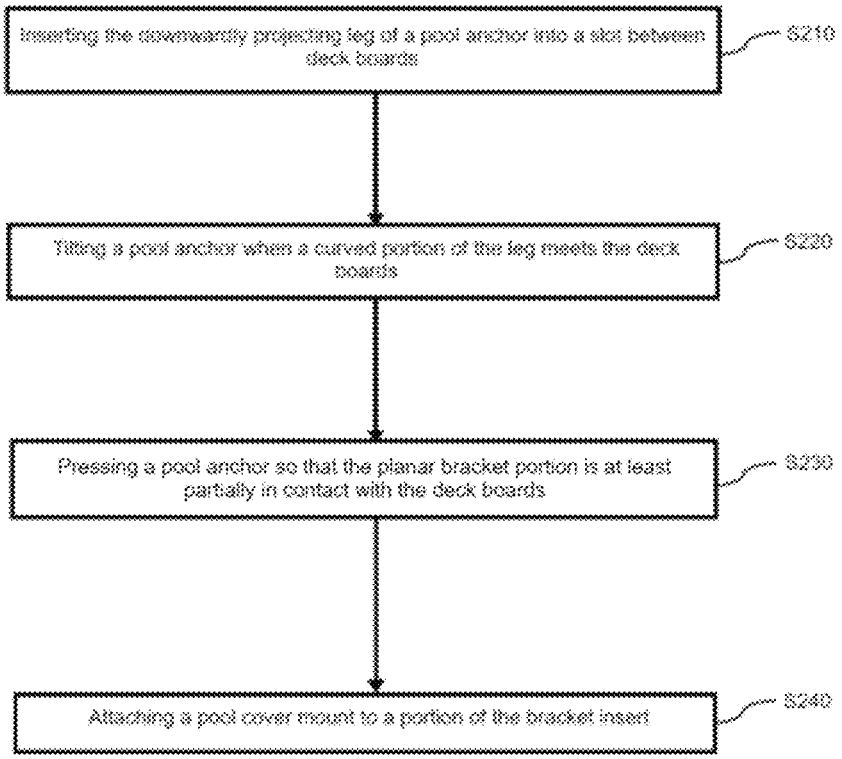
FIG. 24A is a flowchart for installing a pool cover on a deck made of boards.
Figure 24B:
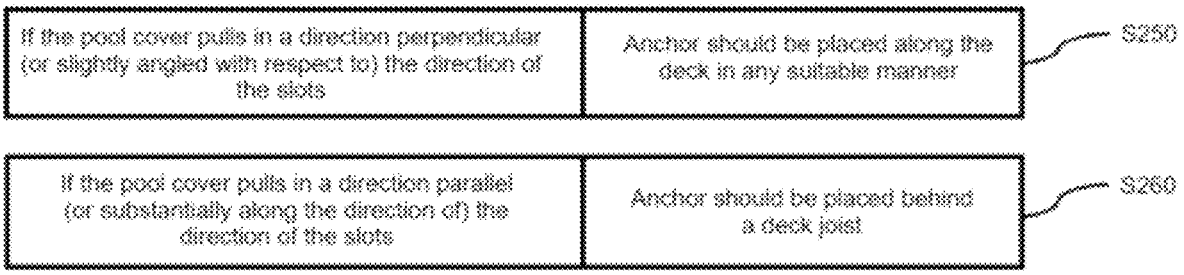
FIG. 24B is a flowchart for installing the anchor depending on the pool cover's directional force.

FIG. 24A is a flowchart for installing a pool cover on a deck 2000. The flowchart relates to a pool anchor 800 that contains a downwardly projecting leg 820 without extending teeth. FIG. 24B is a flowchart that shows how the anchor 800 should be positioned depending on the pool cover's directional force.

At step S210, the downwardly projecting leg 820 of the pool anchor 800 is inserted into a slot between deck boards 2010. For a downwardly projecting leg with at least one longitudinally extending tooth, a user will instead insert the leg into a slot between deck boards such that the at least one tooth will be positioned to point towards a joist. The user will then drive the at least one tooth into the joist.

At step S220, when the curved portion 824 of the leg 820 meets the deck boards, the user will then tilt the pool anchor 800.

At step S230, the user will then press on the pool anchor 800 so that the bracket portion 900 is at least partially in contact with the deck boards 2000.

At step S240, the user will then attach a pool cover mount to the bracket insert 1000. In this step either a pool strap or a tensioning element may be looped around the bracket insert 1000.

Figure 10A:
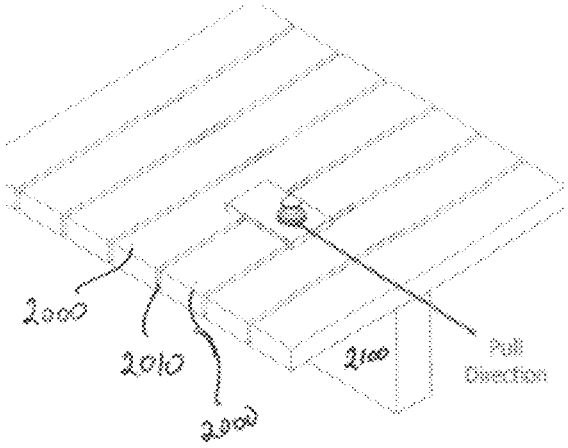
FIGS. 10A-10D are views of the pool anchor installed on the deck.

Step S250 details how a user should place the pool anchor depending on the direction of the pool cover mount's pulling force with respect to the anchor's position on the deck. If the pool cover pulls in a direction perpendicular or slightly angled with respect to the direction of the deck slots 2010 (as also illustrated in FIGS. 10A and 10C), the anchor 800 should be placed along the deck in any suitable manner.

Figure 10B:
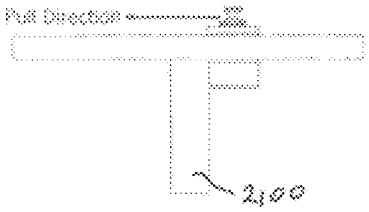
Figure 10C:
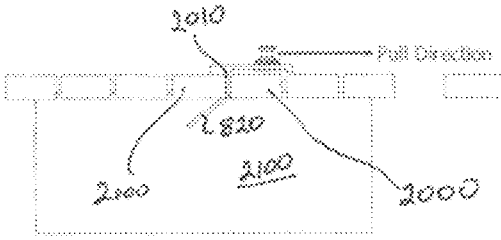
Figure 10D:
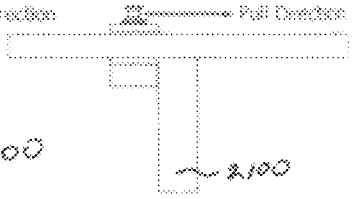
Figures 12A, 12B, 12D:
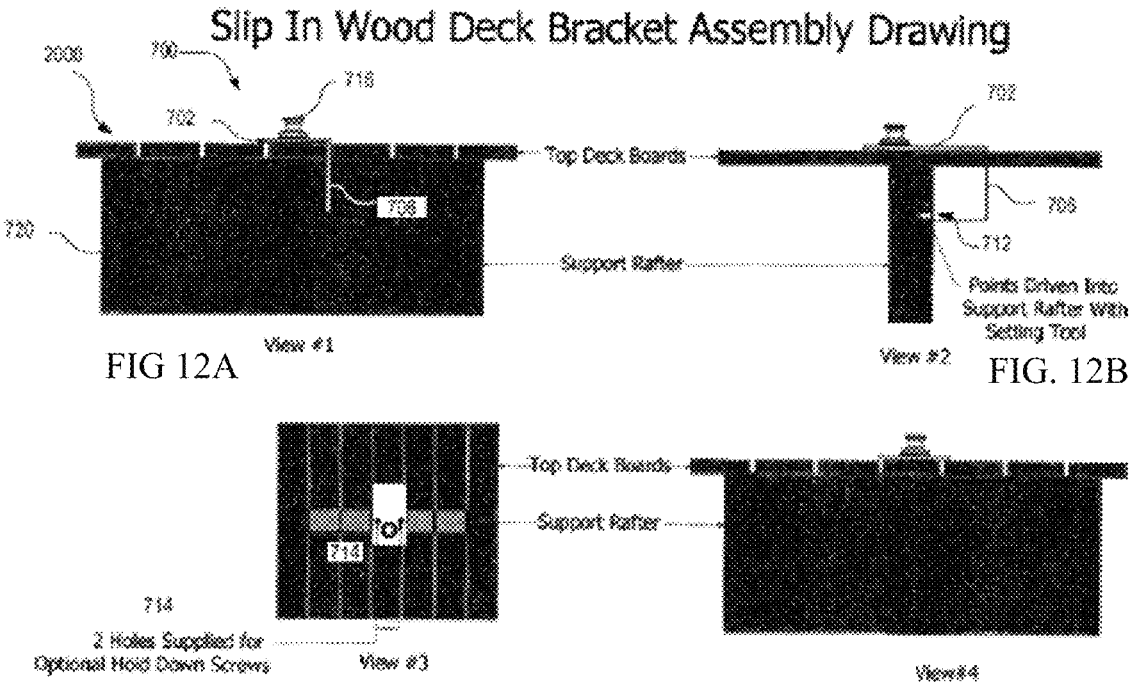
Figure 13A:
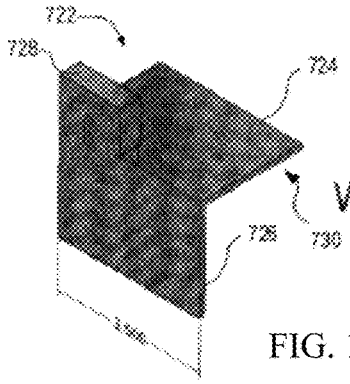
FIGS. 13A-13E show a setting tool in side perspective views, side view, and left and right views.
Figure 13B:
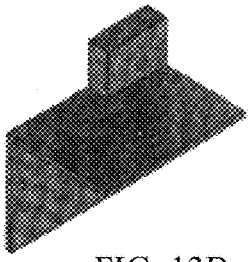
Figure 13C:
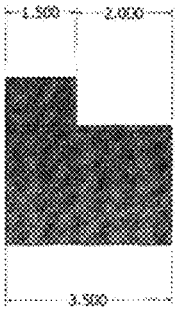
Figure 13D:
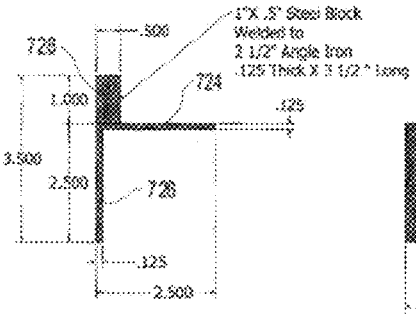
Figure 13E:
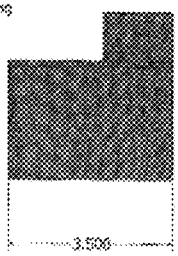
Figure 15A:
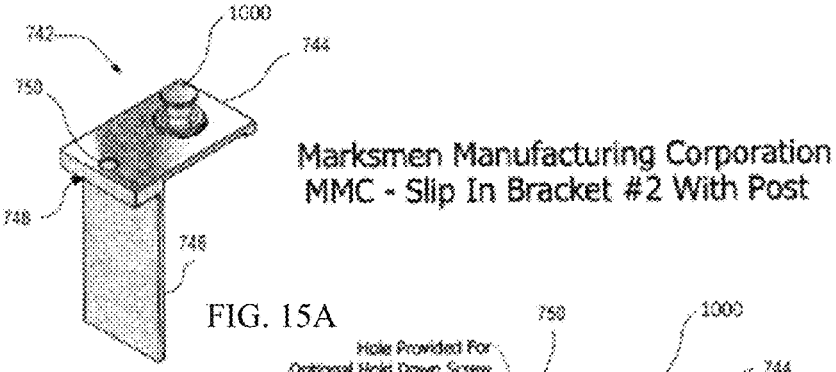
FIGS. 15A-15E show a removable bracket and anchor assembly in side perspective views, front view, back view, and side view.
Figure 15B:
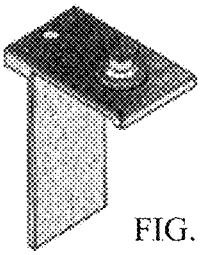
Figure 15C:
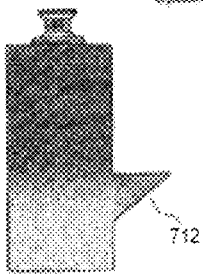
Figure 15D:
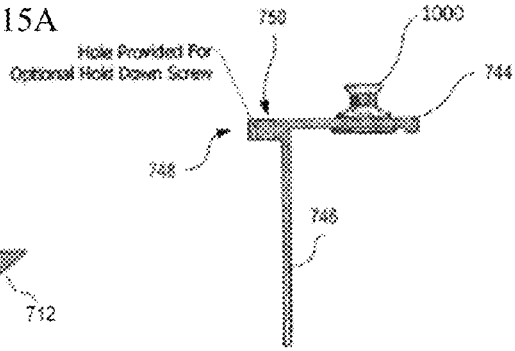
Figure 15E:
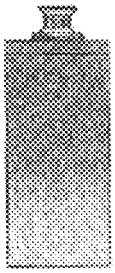

At step S260, if the pool cover pulls in a direction parallel or substantially along the direction of the direction of the deck slots 2010 (as also illustrated in FIGS. 10B and 10C), the anchor 800 should be placed behind a deck joist 2100. Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An anchor comprising:

a planar portion;

a bracket insert that extends from a first side of the planar portion, the bracket insert having a narrowed portion spaced apart from a distal end of the bracket insert, the bracket inset comprising:

a base portion that rests upon a surface of a center section of a second side of the planar portion a knurled portion adjacent to the base portion;

a first end of the narrowed portion adjacent to a proximal end of the bracket insert;

a second end of the narrowed portion adjacent to the distal end of the bracket insert;

a first beveled section that leads into the first end of the narrowed portion; and a second beveled section that leads out of the second end of the narrowed portion; and a downwardly projecting leg that extends from a second side of the planar portion opposite the first side, wherein the downwardly projecting leg comprises:

at least one longitudinally extending tooth; or a base portion that extends perpendicularly from the second side of the planar portion;

a curved portion that extends from the base portion; and a tab end that extends from the curved portion.

2. The anchor of claim 1, wherein the second side of the planar portion is contoured having a mount section, an end section, and a center section between the mount section and the end section.

3. The anchor of claim 2, wherein a thickness of the mount section and the end section is greater than a thickness of the center section.

4. The anchor of claim 3, wherein a thickness of the mount section is greater than a thickness of the end section.

5. The anchor of claim 3 wherein the mount section is chamfered.

6. The anchor of claim 1, wherein the first side of the planar portion defines a hole that goes through to the second side of the planar portion.

7. The anchor of claim 1, wherein the knurled portion is configured to be press-fit in a hole defined in the planar portion.

8. The anchor of claim 7, wherein the base portion is configured to be larger than the hole defined in the planar portion.

9. The anchor of claim 1, further comprising:

a second downwardly projecting leg that extends from the second side of the planar portion, wherein the second downwardly projecting leg mirrors the downwardly projecting leg.

10. The anchor of claim 1, wherein the downwardly projecting leg is perpendicular to the second side of the planar portion.

* * * * *